US006499505B2

(12) United States Patent
Zenker et al.

(10) Patent No.: US 6,499,505 B2
(45) Date of Patent: Dec. 31, 2002

(54) HYDRAULIC VALVE ARRANGEMENT

(75) Inventors: Siegfried Zenker, Kirchseeon (DE); Thorkild Christensen, Sønderborg (DK); Carl Christian Dixen, Sydals (DK); Carsten Christensen, Broager (DK)

(73) Assignee: Sauer-Danfoss (Nordborg) A/S, Nordborg (DK)

( * ) Notice: Subject to any disclaimer, the term of this patent is extended or adjusted under 35 U.S.C. 154(b) by 0 days.

(21) Appl. No.: 09/952,364

(22) Filed: Sep. 11, 2001

(65) Prior Publication Data

US 2002/0029810 A1 Mar. 14, 2002

(30) Foreign Application Priority Data

Sep. 14, 2000 (DE) ..... 100 45 404

(51) Int. Cl.[7] ..... F15B 13/04

(52) U.S. Cl. ..... 137/596.2; 91/420; 91/447

(58) Field of Search ..... 91/420, 447; 137/396.2

(56) References Cited

U.S. PATENT DOCUMENTS 6,220,289 B1 * 4/2001 Zenker et al. ..... 137/596.2
6,427,721 B1 * 8/2002 Zenker et al. ..... 137/596.2

FOREIGN PATENT DOCUMENTS

DE 34 31 103 A1 3/1986

* cited by examiner

*Primary Examiner*—Gerald A. Michalsky
(74) *Attorney, Agent, or Firm*—Altera Law Group, LLC

(57) ABSTRACT

A hydraulic valve arrangement includes a control valve (3), which, in a first operating position (5), connects a motor connection (21) with a pump connection, in a second operating position (6), connects a motor connection with a tank connection, and, in a locking position (4), disconnects the motor connection (21) from the pump and tank connection. A locking valve (19) is coupled between the control valve (3) and the motor connection (21), dividing the motor line (22) into a first section (23) allocated to the control valve (3) and a second section (24) allocated to the motor connection (21). For the locking valve (19), a pressure release valve (20) in the shape of a seated valve is provided that is fixed to the housing thereby improving control accuracy.

6 Claims, 2 Drawing Sheets

HYDRAULIC VALVE ARRANGEMENT

FIELD OF THE INVENTION

The present invention relates to hydraulic valves.

SUMMARY OF THE INVENTION

The invention concerns a hydraulic valve arrangement with a control valve, which, in a first operating position, connects a motor connection with a pump connection, in a second operating position, connects a motor connection with a tank connection, and, in a locking position, disconnects the motor connection from the pump and tank connection, and with a locking valve coupled between the control valve and the motor connection, dividing the motor line into a first section allocated to the control valve and a second section allocated to the motor connection, a pressure release valve made as a seated valve being provided for the locking valve, the operating element of said pressure release valve being loaded in the closing direction by the pressure in the first section and a spring and in the opening direction by a constant control pressure acting in dependence of the position of the control valve and, when operated, releasing the pressure in a spring chamber acting in the closing direction of the locking valve to the first section.

A valve arrangement of this kind, produced by the company Bosch, has been marketed by the company Deutz Fahr. It serves the purpose of displacing a motor in the lifting direction by means of oil pressure and in the opposite direction by means of the load. In this connection, the locking valve is controlled in such a way that a constant lowering speed occurs. The pressure release valve is integrated in the locking valve, the seat of the pressure release valve being arranged in the front wall of the locking valve piston. To ensure generation of the constant control pressure, a branching of a channel leading to the tank is provided immediately next to the operating member of the pressure release valve, said channel having a spring loaded locking valve.

The invention is based on the task of providing a hydraulic valve arrangement as described in the introduction, which has an improved control behaviour.

According to the invention, this task is solved in that the seat of the pressure release valve is fixed to the housing.

With this design, a more stable control is ensured. Firstly, the pressure areas of the pressure release valve and the locking valve are completely independent of each other. Secondly, the operating member of the pressure release valve does not have to follow the load-dependent movement of the locking valve piston, so that the changes of the spring force of the spring belonging to the operating member of the pressure release valve are smaller.

It is advantageous that the pressure release valves are lifting valves with piston-shaped operating elements, arranged in housing bores of a module containing the locking valves. This gives a simple design.

It is also advantageous that the constant control pressure is a continuously generated system pressure, which is supplied in dependence of the position of the control valve. Such a system pressure, which is often already available for other reasons, does not have to build up first, but is practically immediately available. Further, this simplifies the design, as it is not required for each valve module to comprise a constant pressure source.

In a preferred embodiment it is ensured that a system pressure source is formed by the outlet of a pressure valve supplied by the pump pressure, said pressure valve being loaded in the closing direction by the outlet pressure and in the opening direction by the tank pressure and a spring. Such a system pressure source supplies a system pressure of a high constancy.

Such a system pressure source can also be used in connection with a load pressure controlled pump.

A further development of the invention ensures that a second motor connection, a second locking valve and a second pressure release valve are provided for the operation of a motor in both directions.

BRIEF DESCRIPTION OF THE DRAWINGS

In the following, the invention is described in detail on the basis of a preferred embodiment in connection with the drawings, showing.

DETAILED DESCRIPTION OF THE VARIOUS EMBODIMENTS

Figure 1:
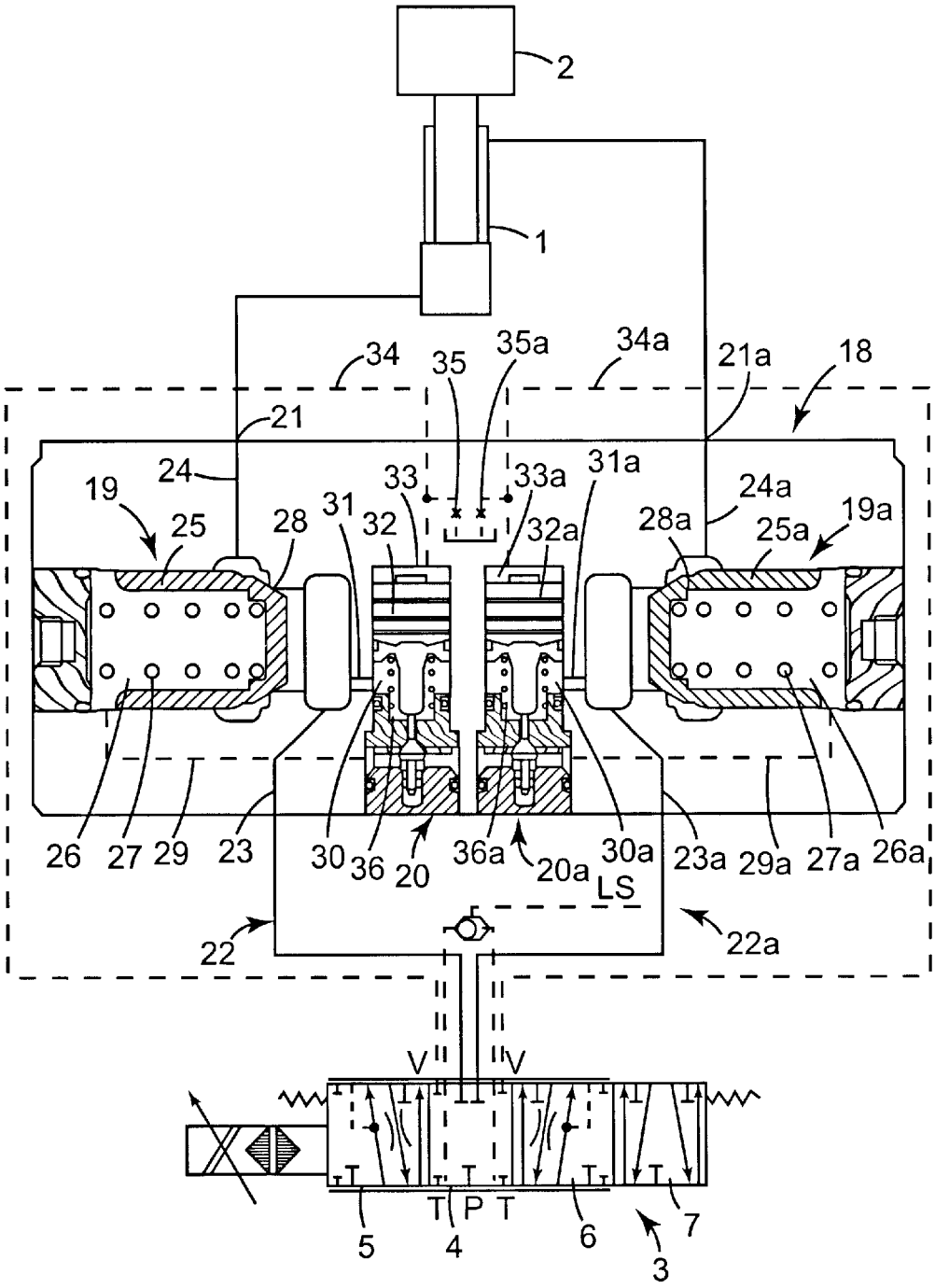
FIG. 1 an embodiment of a valve arrangement according to the invention

For the operation of a motor 1, with which a load 2 can be displaced, a control valve 3 is provided, which can assume four positions, that is, a locking position 4, in which the motor is locked, a first operating position 5, in which the load is moved in one direction, a second operating position 6, in which the load is moved in the other direction, and a floating position 7, in which the load is free to move under the influence of external forces.

Figure 3:
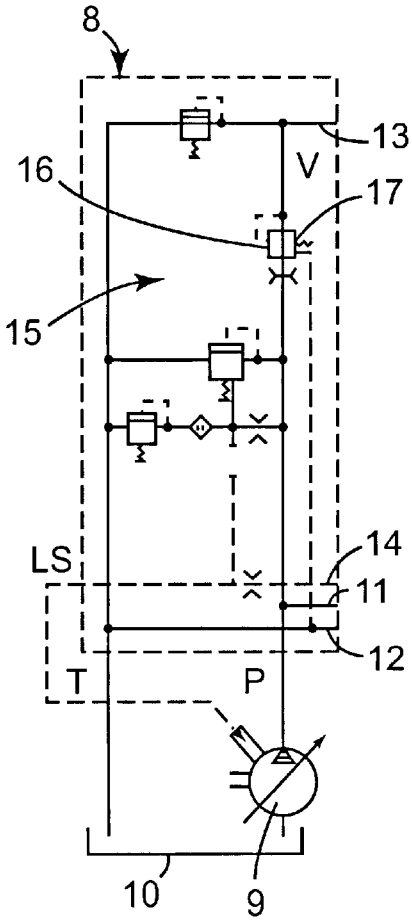

A pump module 8 (FIG. 3) is connected in series with the control valve 3, a pump 9 and a tank 10 being allocated to said module. A pump connection 11 carrying pump pressure P, a tank connection 12 carrying tank pressure T, a control pressure connection 13 carrying control pressure V and a load pressure connection 14 carrying load pressure LS are available. The output of the pump 9 is controlled in dependence of the load pressure LS. A pressure control valve 16 serves as pressure source 15 for the generation of the control pressure V, which valve 16 is loaded in the closing direction by the outlet pressure and in the opening direction by the tank pressure T and a spring 17. Thus, these pressures P, T, V and LS are available at the control valve 3.

A locking valve module 18 has in its housing two locking valves 19 and 19*a* and two belonging pressure release valves 20, 20*a*. The locking valves are coupled between the control valve 3 and the motor 1, so that the two motor lines 22, 22*a* extending from the control valve 3 to the motor connection 21 or 21*a*, respectively, are divided into first sections 23, 23*a* facing the control valve and second sections 24, 24*a* turning away from the control valve. Each locking valve has a piston 25, 25*a* and a spring 27, 27*a* arranged in a spring chamber 26, 26*a*. Via a throttle 28, 28*a*, the spring chamber is connected with the second section 24, 24*a* of the motor line 22, 22*a*, and can be pressure released to the first section 23, 23*a* of the motor line 22, 22*a* via a line 29, 29*a* by means of the pressure release valves 20, 20*a*. For this purpose, the locking valve 20, 20*a* opens towards a first chamber 30, 30*a*, which is connected with the first section 23, 23*a* of the motor line 22, 22*a* via a short channel 31, 31*a*. The locking valve 20, 20*a* has a piston-shaped operating member 32, 32*a*, which is arranged in a bore in the module 18 and separates the first chamber 30, 30*a* from a second chamber 33, 33*a*, which can be supplied with the control pressure V via a control line 34, 34*a*, the control line being provided with a discharge throttle 35, 35*a*. Further, a spring 36, 36*a* is available in the first chamber 30, 30*a*.

Figure 2:
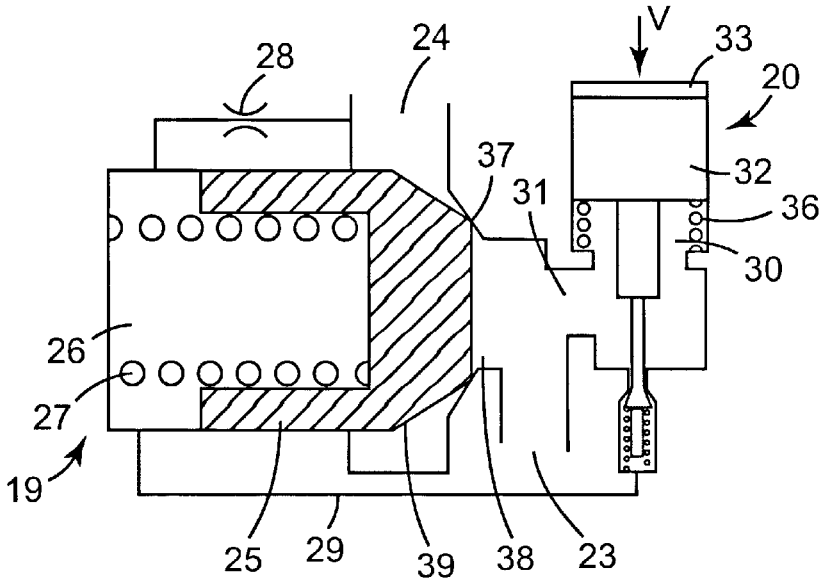
FIG. 2 a simplified view of a locking valve with belonging pressure release valve FIG. 3 a circuit diagram containing a system pressure source

When through operation of the control valve 3 in the second chamber 33, 33*a* the control pressure V is activated, the pressure release valve 20, shown in an enlarged version in FIG. 2, assumes a position, in which the pressure ruling in the first chamber 30 is equal to the control pressure minus the effect caused by the spring 36. When the control pressure is 12 bar and the spring force corresponds to 2 bar, the pressure ruling in the first chamber 30 is 10 bar, which corresponds to an equally large pressure drop at the return flow throttle of the control valve 3. The valve seat 37 of the locking valve 19 divides the pressure area of the piston 25 into an inner area 38 and an outer area 39. When, due to a heavier load on the load 2, a higher pressure builds up in the second section 24 of the motor line and the locking valve consequently opens more, the pressure in the first chamber 30 increases. The pressure release valve throttles more heavily. The pressure in the spring chamber 26 increases and takes the piston 25 closer to the seat 37. This gives an overall return flow quantity per time unit, which is independent of the size of the load 2.

The following modes of operation occur.

1. Locking Function

The control valve 3 assumes the shown position 4, which corresponds to the neutral position. Both lines 34, 34*a*, which lead to the second chamber 33, 33*a*, are disconnected from the system pressure source 15 and held at tank pressure due to the discharge throttles 35, 35*a*. Consequently, the pressure release valves 20, 20*a* are closed. As no pressure release occurs in the spring chamber 26, 26*a*, also the locking valve 19, 19*a* closes tightly. The motor 1 has a fixed position. In this connection, the lines of the load pressure sensing system can be connected with the tank 10, as known per se and desirable.

2. Operating Function

This corresponds to the position 5 or 6 of the control valve 3. In the operating position 5, the supplied pressurised fluid forces the locking valve 19 open. At the same time, the pressure release valve 20*a* is opened, as control pressure V is supplied via the line 34*a*, because a corresponding connection with the system pressure source 15 was established in the control valve 3. Consequently, the spring chamber 26*a* of the locking valve 19*a* is pressure released. Thus, under the influence of the returning pressurised fluid, it can also open, a predetermined pressure in the first chamber 30*a* or the first section 23*a*, however, being maintained. Similar conditions occur in the operating position 6.

3. Floating Function

In the floating position 7, both lines 34, 34*a* of the control valve 3 are connected to the system pressure source 15, that is, supplied with control pressure V. Thus, both pressure release valves 20, 20*a* are opened. Both spring chambers 26, 26*a* are released. Small pressure increases at one of the motor connections 21, 21*a* will be sufficient to open the locking valves. Therefore, the motor can displace freely in dependence of its foreign loads.

The dependence of the control pressure on the position of the control valve can be realised in several ways. In stead of the shown break distances on the slide of the control valve 3, also a switch operated simultaneously with the control valve can be used. With an electrically operated control valve, the electrical signal can influence the control pressure. With a bus-controlled valve, bus signals can be obtained for the control.

Instead of the load pressure dependently controlled pump, also a fixed displacement pump can be used.

What is claimed is:

1. A hydraulic valve arrangement comprising: a control valve, which, in a first operating position, connects a motor connection with a pump connection, in a second operating position, connects the motor connection with a tank connection, and, in a locking position, disconnects the motor connection from the pump and tank connection, and with a locking valve coupled between the control valve and the motor connection, dividing a motor line into a first section allocated to the control valve and a second section allocated to the motor connection, a pressure release valve made as a seated valve being provided for the locking valve, an operating element of said pressure release valve being loaded in a closing direction by pressure in the first section and a spring and in an opening direction by a constant control pressure acting in dependence of the position of the control valve and, when operated, releasing the pressure in a spring chamber acting in the closing direction of the locking valve to the first section, wherein a seat of the pressure release valve is fixed to a housing.

2. The hydraulic valve arrangement according to claim 1 wherein the pressure release valve is a lifting valve with a piston-shaped operating element arranged in a housing bore of a module containing the locking valve.

3. The hydraulic valve arrangement according to claim 1 wherein the constant control pressure is a continuously generated system pressure, which is supplied in dependence of the position of the control valve.

4. The hydraulic valve arrangement according to claim 3, wherein a system pressure source is formed by an outlet pressure of a pressure valve supplied by the pump pressure, said pressure valve being loaded in a closing direction by the outlet pressure and in an opening direction by tank pressure and a spring.

5. The hydraulic valve arrangement according to claim 4, wherein the pump is load pressure controlled.

6. The hydraulic valve arrangement according to claim 1, wherein a second motor connection, a second locking valve, and a second pressure release valve are provided for the operation of a motor in both directions.

* * * * *